United States Patent [19]

Jurgensen

[11] 3,983,356

[45] Sept. 28, 1976

[54] END LOAD FOR MICROWAVE OVENS

[75] Inventor: Peter D. Jurgensen, San Carlos, Calif.

[73] Assignee: Gerling Moore Inc., Palo Alto, Calif.

[22] Filed: Apr. 30, 1974

[21] Appl. No.: 465,489

[52] U.S. Cl. ..... 219/10.55 A

[51] Int. Cl.[2] ..... H05B 9/06

[58] Field of Search ..... 219/10.55 A, 10.55 R, 219/10.55 F; 333/81 B, 81 R

[56] References Cited

UNITED STATES PATENTS

| | | | |
|---|---|---|---|
| 3,365,562 | 1/1968 | Jeppson | 219/10.55 A |
| 3,624,335 | 11/1971 | Dench | 219/10.55 D |
| 3,665,141 | 5/1974 | Schiffmann | 219/10.55 A |
| 3,749,874 | 7/1973 | Edgar | 219/10.55 A |
| 3,754,111 | 8/1973 | Jurgensen | 219/10.55 A |
| 3,848,106 | 11/1974 | Beuggren et al. | 219/10.55 A |

*Primary Examiner*—Bruce A. Reynolds
*Attorney, Agent, or Firm*—Flehr, Hohbach, Test et al

[57] ABSTRACT

An end load for a microwave oven for efficiently attenuating microwave energy escaping from an oven access port. The end load has a circular configuration and consists of an inner cylindrical member and a concentrically mounted, outer conductive member. The members are spaced apart to provide a tuned annular volume through a lossy liquid, such as water, is passed. The inner member is made of a microwave lossy material having a dielectric constant that optimumly matches the energy transfer from air to water and has a wall thickness that is also tuned to trap microwave energy. The outer member is made of a conductive material that provides an inwardly reflective surface for confining the microwave energy.

5 Claims, 3 Drawing Figures

END LOAD FOR MICROWAVE OVENS

BACKGROUND OF THE INVENTION

This invention relates to microwave ovens and, more particularly, to the ovens that have materials continuously passing through them. For such continuous processes a means of access must be provided to the oven in order to permit the passage of a conveyor belt and/or the product. However, any physical opening or access port in a microwave oven creates some leakage hazard to the operating personnel. Moreover, substantial leakage occurs for any practical sized opening and the amount of energy released is even more hazardous because of the typical operating frequencies of the microwave ovens.

Previous structures have utilized various types of filters, cavities, cutoff structures, capacitive structures, slot reflectors, and water jackets. In particular, a water jacket forming an annulus around the conveyor belt and product has the advantages of conveniently carrying off the leakage energy heat and having a high microwave loss. Typical water jacket structures that have been proposed contain the water between a metal outer jacket and an inner insulation or tubing. The outer jacket serves both as a reflective member and also a containment for the microwave energy. The inner insulation comprises the actual envelope through which the conveyor belt longitudinally passes and through which the microwave energy transversely passes into the water.

The use of an annular water jacket has the difficulty of reflecting an excessive portion of the microwave energy back into the open area around the conveyor belt and not efficiently absorbing the microwave energy. The dielectric constant of water at microwave frequencies is about 80, whereas the dielectric constant of air is approximately 1. The discontinuity between these two dielectric constants is so great that only about one-seventh of the total energy impinging upon the water surface is able to actually pass into it. Thus, even though water is one of the best microwave attenuation mediums, the amount of reflection at an air-water boundary requires that known end loads be made quite long in order to be sufficiently effective.

In addition, the prior structures, such as that shown in U.S. Pat. No. 3,754,111, entitled "Access Tunnel and Attenuator for Microwave Ovens", issued to Peter D. Jurgensen and assigned to the same assignee as the present application, have required dimensional tolerances that are difficult to obtain by normal manufacturing methods. There is, therefore, a need for an improved microwave oven end load.

SUMMARY OF THE INVENTION AND OBJECTS

In general, it is an object of the present invention to provide a microwave oven end load which will overcome the limitations and disadvantages of the prior art.

Another object of the present invention is to provide an efficient microwave end load that is dimensionally short while still meeting the governmental safety requirements.

Another object of the present invention is to provide a microwave end load having a circular configuration that will accommodate circular products and/or a conveyor belt.

Another object of the present invention is to provide a microwave end load that is constructed from easily obtainable materials and requires dimensional tolerances that can be more easily obtained.

Another object of the present invention is to provide a microwave oven which more effectively utilizes a water jacket for absorbing microwave energy by employing a tuned structure.

The present invention uses the water jacket principle in combination with a particular configuration and dimensioning of selected materials so that the overall absorption efficiency of microwave energy is increased many fold. The invention contemplates using a transition medium between the air inside of the end load and the water jacket. The jacket consists of an outer cylindrical member that is made of a conductive material that provides an inwardly reflective surface for confining the microwave energy. Within the outer cylindrical member is disposed an inner member which is fabricated from a microwave lossy material having a dielectric constant which is equal to the square root of the product of the dielectric constants of water and air. This material enhances the transference of microwave energy through the surface of the water in the water jacket while absorbing microwave energy itself. In addition, the thickness of the water annulus of the water jacekt and the wall thickness of the inner member are dimensioned to trap microwave energy both within the inner member and in the water annulus.

Additional objects and features of the invention will appear from the following description in which the preferred embodiment has been set forth in detail in conjunction with the accompanying drawings.

DESCRIPTION OF THE PREFERRED EMBODIMENT

Figure 1:
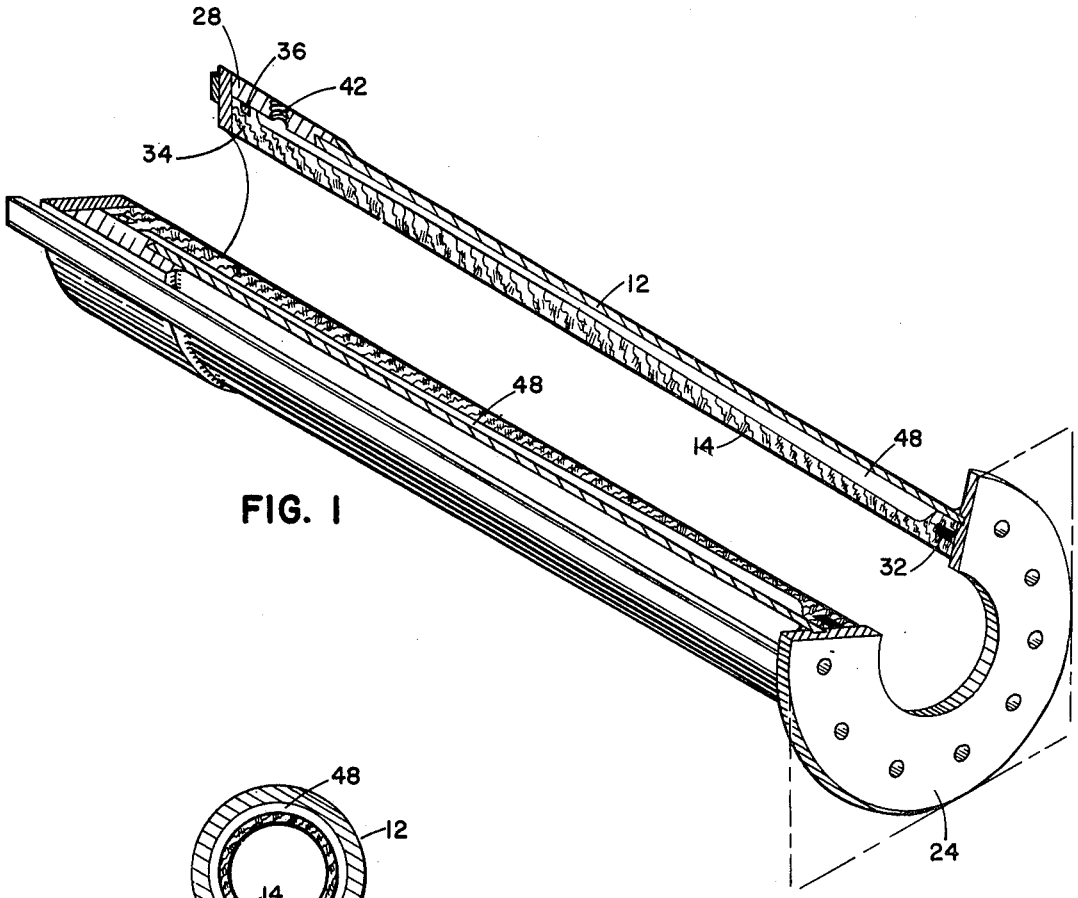
FIG. 1 is an isometric view partially cut away showing a circular end load for a microwave oven in accordance with the present invention.
Figure 3:
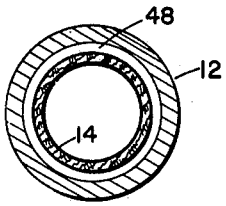
FIG. 3 is a cross-sectional view taken along the lines 3—3 of FIG. 2.
Figure 2:
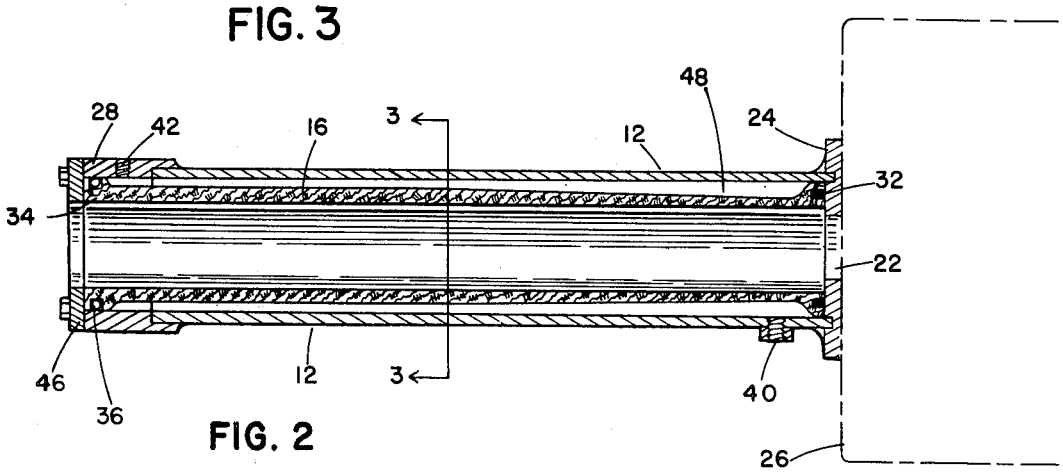
FIG. 2 is an elevational view in cross-section of the circular end load of FIG. 1 showing, in addition, an associated material support roller and a microwave oven supporting the end load.

Referring to FIGS. 1 through 3, there is shown a circular microwave end load which consists generally of an outer cylindrical member 12 and an inner cylindrical member 14. The two members are concentrically disposed with respect to each other and are supported so that one end is in intimate contact with a microwave oven 20. The two members are further symmetrically disposed with respect to an access port 22 provided in the microwave oven. The members 12, 14 serve as an access tunnel for permitting material to be introduced or withdrawn from the microwave oven. The material can be delivered to or extracted from the oven by a conveyor belt (not shown) passing longitudinally through the tunnel.

In the following discussion reference will be made to a particular end load tunnel construction suitable for use at one particular frequency (2450 MHZ). It should be understood that particular dimensions given, in absolute terms, are not to be taken as a limitation on the invention but as an aid in understanding this example.

The outer member 12 is a circularly cylindrical shell made from a conductive metal. The member has an inside diameter of 7 inches and is axially aligned with the access port 22 in the oven 20. The free end of the outer member terminates in a collar 28 also having a 7 inch inside diameter but having a greater cross-section to provide rigidity. The collar is secured to the outer member by welding or by other suitable means. The outer member is also secured to a support flange 24 by welding. The support flange attaches the entire unit to the oven by bolting the oven to the oven sidewall 26. The flange has a central opening therein which is made to correspond with the access port 22 in the oven. When the flange is attached to the endwall, the entire unit is supported thereby in close fitting and fixed position to the oven.

The inner member 14 is a circularly cylindrical section of asbestos cement water pipe. One example of this type of pipe is Class 150, 6 inch diameter by 3 feet 3 inches long, pipe having an outside diameter of 6.9 inches and an inside diameter of 5.8 inches. This pipe is available from the Johns Manville Company and is commonly known as "Transite" water pipe. The inner member 14 is cut and milled into the shape shown in the drawings and into the dimensions hereinafter described. The end 30 of the inner member nearer the oven 20 is provided with an increased outer radius so that the end wall thereof can accommodate an O-ring seal 32. The other end 34 remote from the oven is also provided with an increased radius to accommodate a radially inwardly compressable O-ring seal 36.

The outside diameter of the inner member 14 is somewhat smaller than the inside diameter of the outer member 12. The difference in these diameters defines an annular region therebetween which, by virtue of the O-ring seals 32, 34 forms an annular enclosed volume. On the bottom of the outer member near the oven 20 is provided a water inlet port 40 adjacent to the flange 24. On the top of the outer member near the free end 34 is provided a water outlet port 42. The inlet and outlet ports permit a flow of water to be maintained through the end load. This flow of water removes the heat generated by the absorption of microwave energy developed during operation of the oven.

The assembly of the end load is straightforward. First, the O-ring seals 32, 36 on the inner member 14 are disposed in their respective recesses. The inner member 14 is then inserted into the outer member 12 until the O-ring seal 32 contacts the support flange 24. During this insertion, the O-ring seal 36 becomes radially compressed by the collar 28. The assembly is completed by bolting an end flange 46 to the collar 28. Each part of the end load is dimensioned so that a close tolerance fit is obtained when the parts are drawn together. In this way a leakproof water jacket is formed.

The dimensions of the assembled end load are adjusted to maximize the efficiency of microwave energy absorption and thereby minimize the overall length of the end load while satisfying government safety regulations. It has been found that to transfer the maximum amount of microwave energy into the water within the annulus 48 to the inner member 14 should have a dielectric constant equal to the square root of the product of the dielectric constants of air and water. At the frequencies that microwave ovens are usually operated air has a dielectric constant of about 1 and water about 80. Thus, the optimum dielectric constant for member 14 is about 9.

It has been found that asbestos cement pipe has an effective dielectric constant of about 9, and in addition, this material has high attenuation characteristics with respect to microwave energy. One asbestos cement pipe which has been found satisfactory for use in the present invention is that pipe commonly available from Johns Manville Company under the trademark "Transite" and ordinarily used for water pipe. More specifically, Class 150 Transite has been used. This pipe is made from a mixture of Portland cement, asbestos fiber and silica that is cured under pressure and heat.

It should be understood, however, that other materials can be substituted providing that these materials meet the criteria set forth herein. In general, it is felt that any water-tight asbestos cement pipe could be satisfactory. This type of pipe is generally composed of intimate mixtures of Portland cement or Portland blast furnace slag cement and asbestos fiber with, or without, silica, or of Portland pozzolan cement and asbestos fiber, the mixture being formed under pressure and heat into a homogeneous cured structure.

The optimum wall thickness for the inner member 14 is equal to ¼ of the wavelength of the microwave radiation incident thereon divided by the square root of the dielectric constant of the wall material. For usual wavelengths at which microwave ovens operate and for asbestos cement pipe having a dielectric constant of 9, the inner member should have a wall thickness of about 0.4 inches.

The optimum thickness for the annulus of water in the water jacket 48 is computed from a similar formula. This dimension is equal to ¼ of the wavelength of the microwave radiation divided by the square root of the dielectric constant of water. For the usual wavelengths at which microwave ovens operate, the formula gives a thickness of 0.133 inches. Experiment has shown, however, that the actual optimum for the water annulus thickness is about 0.200 inches.

By way of specific example, the circular end load adapted for use with a microwave oven operating at 2450 MHZ and disclosed herein had the following additional dimensions; overall length, 2 feet; diameter of access port to the oven, 5 inches; inside diameter of asbestos cement inner member, 5.8 inches; outside diameter of asbestos cement inner member, 6.6 inches; asbestos cement inner member thickness, 0.4 inches; and water annulus thickness, 0.20 inches.

With the foregoing dimensioning, it is believed that the end load is doubly resonant. In other words, microwave energy is trapped both within the inner member 14 and within the water annulus 48.

To give it a hard, glazed surface and seal, the entire asbestos cement inner member 14 was coated with sodium silicate, commonly known as water glass.

During operation the end load is hereinbefore described was found to be so efficient at absorbing microwave energy that the heat and strength limitations of the asbestos cement pipe were exceeded in the region immediately adjacent the microwave oven 20. To avoid cracking and structural failure of the inner member, it was found expedient to detune the end load system so that it absorbed less efficiently in the region near the oven. More specifically, for the nominal 6 inches, 2 foot long, asbestos cement pipe disclosed herein, a gradual 1°20′ taper was milled into the outer wall diameter continuously over an 8 inch distance as it approached the end near the microwave oven. For the purpose of clarity, this taper has been somewhat exaggerated in the drawings.

The specific example of a circular end load described hereinabove fully satisfied current government regulations. On a 4′ × 4′ × 4′ galvanized cavity subjected to 25 watts of input power, the power density of microwave leakage out of a 5 inch diameter hole was measured at 50 milliwatts per square centimeter. By using a scaling factor, the corresponding input power of 15 kilowatts would cause leakage of 3,000 milliwatts per square centimeter. The current government regulations prescribe a maximum leakage of 10 milliwatts per square centimeter. The total attenuation required to reduce the leakage to the permitted level is equal to the leakage without an end load divided by the maximum allowed leakage. This ratio is a factor of 3,000 to 1 or 34.75 db. The attenuation per unit length is 1.45 db per inch. The power dissipation in the end load can be computed to be 3.78 kilowatts, and these requirements are exceeded by the end load of the present invention.

While the preferred embodiment disclosed herein describes the use of a particular combination and arrangement of materials which are reasonable in cost and structurally stable in operation, it should be realized that the substitution of other equivalent materials may be made while still remaining within the scope and purposes of the present invention.

Where extremely high energy absorbance per unit length is required, an additional intermediate member can be provided between the inner wall of the inner member 14 and the air. This additional intermediate member could be either tuned or untuned. In order to provide a suitable match such an additional member should ideally have a dielectric constant of approximately 3. There is a wide range of materials having this dielectric constant and most are readily available.

Further, while a specific construction and arrangement of parts for providing a water-tight seal has been disclosed herein, other sealing arrangements may be used without departing from the spirit and scope of the present invention.

While the form factor shown in the present is circular, other forms and shapes can also be constructed in accordance with the present invention. Thus, cross-sections that are elliptical, rectangular or square can also be made should the need arise. Thus, as used herein, cylindrical should be taken in the broadest sense as including any tubular shape whether right circular, square or other.

Accordingly, although one example of the best mode contemplated for carrying out the present invention has been herein shown and described, it will be apparent that many modifications and variations may be made without departing from what is regarded to be the subject matter of the invention.

I claim:

1. An end load for providing access to a microwave oven having means forming a port through the wall thereof, said end load comprising an inner cylinder member made of cured asbestos cement having an internal dimension corresponding to said port, an outer cylindrical member concentrically supported about said first member, said outer member being made of conductive material to provide an inwardly facing reflective surface, said outer conductive member being spaced apart a predetermined distance from said first member thereby defining an annular region therebetween, means sealably interconnecting the ends of said inner and outer members into a unitary structure, means for interconnecting said end load to said microwave oven such that one end of the bore of said inner member opens into said port of said oven, means forming water inlet and outlet to the region between said inner and outer members, said inner member being made of dielectric material having a dielectric constant of about the square root of the product of water and air, means for delivering water to said end inlet, said inner member having a thickness of approximately one-fourth of the wavelength of the microwave energy being used within said oven divided by the square root of the dielectric constant of said inner member, and further in which the inner and outer members defining said annular region are spaced apart a distance of approximately one-fourth of the wavelength of said microwave energy divided by the square root of the dielectric constant of water.

2. Apparatus as in claim 1 in which said inner member is made of a microwave lossy material.

3. Apparatus as in claim 2 in which said first shell is tapered down gradually as it approaches the end adjacent said microwave oven so that microwave energy is absorbed less efficiently immediately adjacent the oven and gradually more efficiently in regions progressively further from said oven.

4. Apparatus as in claim 1 in which said asbestos cement inner member is of a type manufactured from an intimate mixture of Portland cement, asbestos fiber, and silica cured under heat and pressure.

5. An end load for providing access to a microwave oven having means forming a port through the wall thereof, said end load comprising an inner cylindrical member having an internal dimension corresponding to said port, an outer cylindrical member concentrically supported about said first member, said outer member being made of conductive material to provide an inwardly facing surface reflective to microwaves, said outer conductive member being spaced apart a predetermined distance from said first member thereby defining an annular region therebetween having a thickness of approximately one-fourth of the wavelength of said microwave energy divided by the square root of the dielectric constant of said liquid, means sealably interconnecting the ends of said inner and outer members into a unitary structure, means for interconnecting said end load to said microwave oven such that one end of the bore of said inner member opens into said port of said oven, means forming a liquid inlet and outlet to the region between inner and outer members, said inner member being made of dielectric material having a dielectric constant of approximately the square root of the product of said liquid and air, means for delivering liquid to said end inlet, said inner member having a thickness of approximately one-fourth of the wavelength of the microwave energy being used within said oven divided by the square root of the dielectric constant of said inner member.

* * * * *